US005297982A

United States Patent [19]

Filoseta

[11] Patent Number: 5,297,982

[45] Date of Patent: Mar. 29, 1994

[54] TOY VEHICLE HAVING LOAD RESPONSIVE TRANSMISSION

[75] Inventor: Miva A. Filoseta, Los Angeles, Calif.

[73] Assignee: Mattel, Inc., El Segundo, Calif.

[21] Appl. No.: 833,188

[22] Filed: Feb. 10, 1992

[51] Int. Cl.[5] ..... A63H 29/00

[52] U.S. Cl. ..... 446/448; 446/463; 74/337; 180/338

[58] Field of Search ..... 446/463, 457, 448, 433, 446/437; 74/337; 180/338

[56] References Cited

U.S. PATENT DOCUMENTS

| | | | |
|---|---|---|---|
| 1,807,367 | 5/1931 | Woolery | 74/337 |
| 3,377,742 | 4/1968 | Sheldon et al. | 446/446 |
| 4,290,227 | 9/1981 | Shimamura | 74/337 X |
| 4,545,451 | 10/1985 | Pipa et al. | 446/463 X |

*Primary Examiner*—Mickey Yu
*Attorney, Agent, or Firm*—Roy A. Ekstrand

[57] ABSTRACT

A toy vehicle includes a toy vehicle body, a plurality of drive wheels coupled to the body, a motor having an output shaft, a gear drive coupled to the output shaft and a transmission having a changeable gear ratio coupling the gear drive to at least one of the wheels responsive to the load imposed upon the transmission and changing the gear ratio in response thereto.

5 Claims, 3 Drawing Sheets 10
11
22
31
13
20
32
30
16
14
18

14
20
10
11
32
13
22
16
19
31

TOY VEHICLE HAVING LOAD RESPONSIVE TRANSMISSION

FIELD OF INVENTION

This invention relates generally to toy vehicles and particularly to the power transmission systems used therein.

BACKGROUND OF THE INVENTION

Motorized toy vehicles have proven to be a consistent and popular product among young children over a wide range of ages. The design and character of such motorized toy vehicles has varied dramatically as practitioners have attempted to provide a variety of interesting and amusing toy vehicles. Generally speaking, such toy vehicles include a vehicle body and chassis within which a battery power supply and an electric drive motor are supported. Because of the characteristics of electric motors which generally operate best at higher speeds of revolution and with lower torque than the axle revolution speed practical in such toys, a speed reduction gear set or transmission is generally interposed between the driven axles and the motor output shaft.

One of the critical factors in successfully producing a battery driven toy vehicle is the attainment of performance of the vehicle while maintaining battery life. In many situations, these two objectives are somewhat incompatible in that high performance drive systems tend to use prohibitive amounts of battery power and therefore deplete the battery power supply quickly.

One of the critical elements in the design of such toy vehicles in attempting to meet a performance and battery life balancing is the selection of the gear ratios which couple the motor power to the driven axle. For example, a low gear ratio favors vehicle power and permits the use of a lower current motor which extends battery life. However, lower ratios in the vehicle drive gears limit the available speed of the vehicle and therefore reduce a desirable performance characteristic.

To further complicate the design of such toy vehicles, the vehicle in normal use encounters a great variation of surface and load characteristics. Thus, a child in a typical play pattern may often desire that the toy vehicle be able to climb substantial inclines on the one hand while providing high speed across flat surfaces on the other hand. This variation of loading for surface characteristic is usually more difficult and challenging for toy vehicles produced to replicate the so-called "monster trucks" or four-wheel drive trucks which the child user frequently desires to see replicate the climbing and power characteristics of the full-sized vehicles which they emulate. To provide a better balance between performance and battery life and meet the other operational variations imposed upon such toy vehicles, practitioners in the art have attempted to provide transmissions which may be switched between speed and power gear ratios by the child user. Most of such devices have provided a shift lever which extends from the vehicle body and which may be hand operated by the child user. While this provides some improvement in performance in that gear ratio may be varied, it often detracts from the play value of the toy vehicle by interposing an unrealistic physical configuration or appearance. There remains, therefore, a need in the art for an improved toy vehicle which meets the variety of operational circumstances in which such toy vehicles are required to perform and which, nonetheless, conserves battery life.

SUMMARY OF THE INVENTION

Accordingly, it is a general object of the present invention to provide an improved motor driven toy vehicle. It is a more particular object of the present invention to provide an improved motor driven toy vehicle having a variable speed transmission therein. It is a still more particular object of the present invention to provide an improved motor driven toy vehicle which provides high performance while conserving battery life.

In accordance with the present invention, there is provided a toy vehicle comprises: a toy vehicle body; a plurality of drive wheels coupled to the body; a motor having an output shaft; gear means coupled to the output shaft; and transmission means having a changeable gear ratio coupling the gear means to at least one of the wheels responsive to the load imposed upon the transmission means and changing the gear ratio in response thereto.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
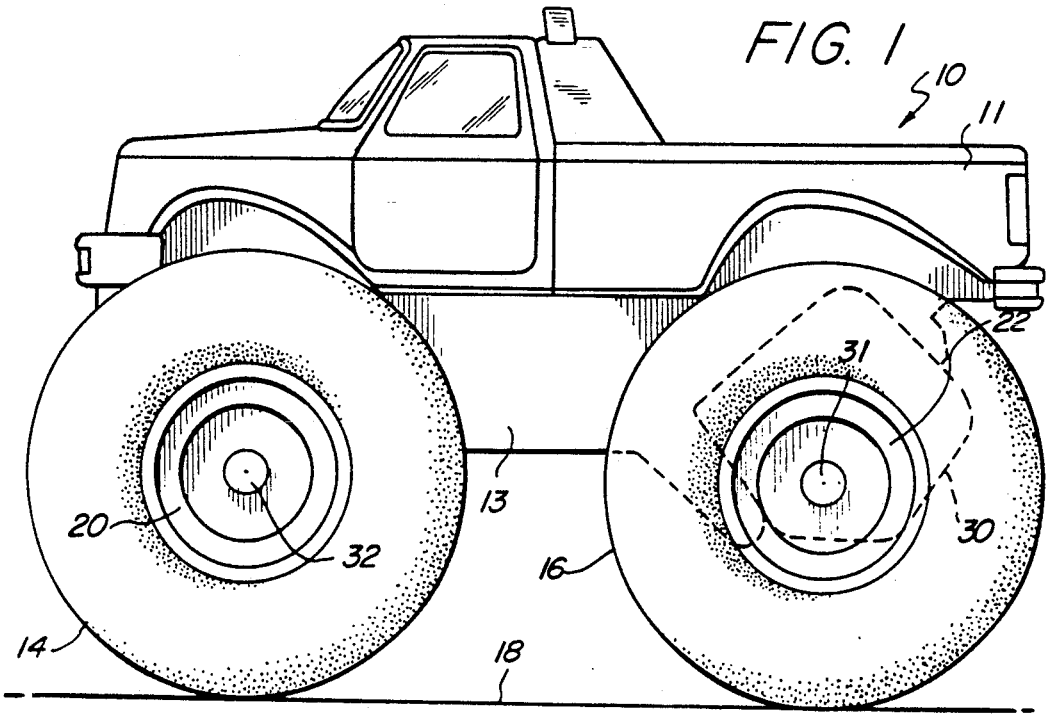
FIG. 1 sets forth a side view of a toy vehicle constructed in accordance with the present invention.

FIG. 1 sets forth a side view of a toy vehicle constructed in accordance with the present invention and generally referenced by numeral 10. Toy vehicle 10 includes a truck body 11 configured to replicate an off road or four-wheel drive type pick-up truck. Truck 10 further includes a support chassis 13 which, by conventional attachment means supports a front axle 32. A pair of front wheel hubs 20 and 21 (the latter not seen in FIG. 1) are received upon and supported by front axle 32 in a rolling attachment in accordance with conventional fabrication techniques. A pair of enlarged front tires 14 and 15 (the latter not seen in FIG. 1) are secured to hubs 20 and 21 in accordance with conventional fabrication techniques and provide rolling support for the front portion of truck 10.

In accordance with the present invention, truck 10 further includes a transmission 30 secured to support chassis 13 in the manner described below in greater detail. Transmission 30 supports a rear axle 31 which in turn is coupled to a pair of rear wheel hubs 22 and 23

(the latter not shown in FIG. 1). Hubs 22 and 23 support a pair of enlarged tires 16 and 17 respectively (the latter not shown in FIG. 1). In further accordance with the present invention and as is set forth below in greater detail, transmission 30 includes a battery driven electric drive motor together with a two speed transmission drive coupling operative upon axle 31 which responds to the imposed load upon axle 31 and transmission 30 to select the appropriate gear for either standard speed or increased power automatically.

Figure 2:
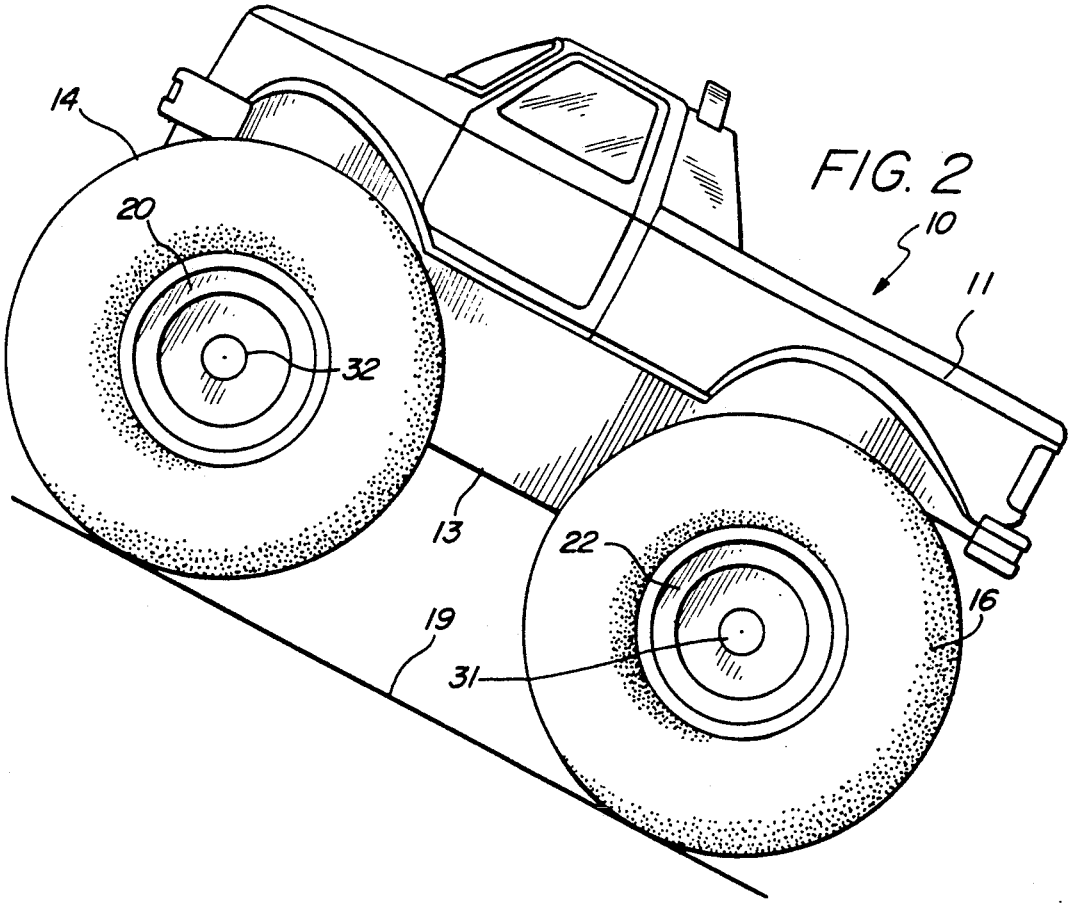
FIG. 2 sets forth a side view of the present invention toy vehicle operating on an inclined surface.

FIG. 2 sets forth truck 10 operating upon an inclined surface 19. Comparison of FIGS. 1 and 2 shows that, in FIG. 1, toy vehicle 10 is operating upon a generally flat surface 18 and thus it is anticipated that a relative light resisting load will be imposed upon the drive system of toy vehicle 10. Thus, in accordance with the present invention operation of transmission 30 set forth below in greater detail, transmission 30 responds to the relatively light opposing load encountered and automatically shifts into a standard speed gear ratio coupling configuration which provides the desired travel speed for toy vehicle 10.

Conversely, in FIG. 2, the incline of surface 19 imposes a significant resisting load upon the drive system of toy vehicle 10 which is sensed by transmission 30. The structure and operation of transmission 30 is described and shown below in greater detail. However, suffice it to note here that by the operation thus described, transmission 30 senses the increased load upon the drive system of toy vehicle 10 presented by inclined surface 19 and responds by shifting the gear coupling within the transmission to a lower speed higher power gear ratio which greatly increases the climbing capability and drive power of toy vehicle 10. It will be apparent to those skilled in the art that while a simple inclined surface 19 is shown in FIG. 2 as the circumstance imposing additional load upon toy vehicle 10, the increased load which produces the desired gear shifting of the present invention transmission may be encountered in a virtually endless number of situations including the imposition of obstructions or rough terrain in the travel path of vehicle 10. An important aspect of the present invention common to all such situations is the ability of transmission 10 to respond to the increased load or resistance to travel imposed upon the drive system by such circumstances and shift the drive gear ratio to the lower speed higher power gear ratio.

Figure 3:
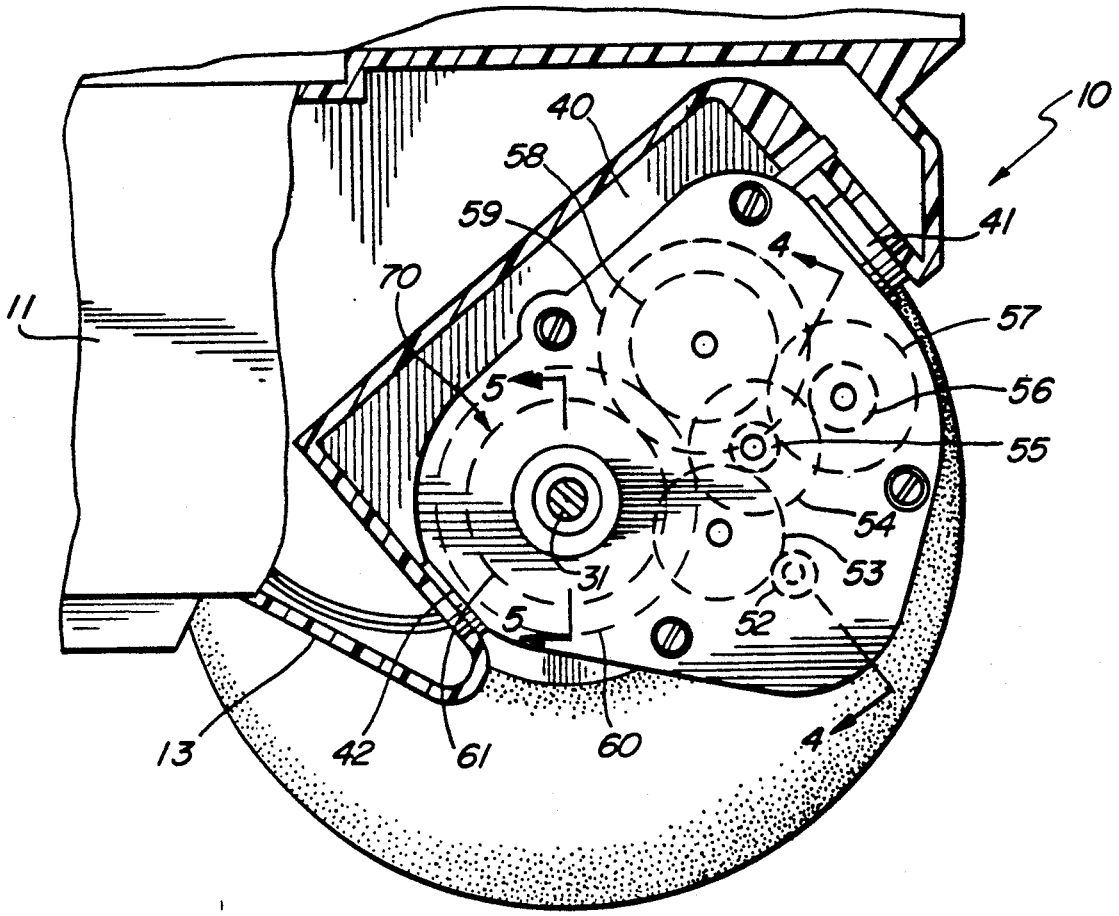
FIG. 3 sets forth a partial section view of the motor drive portion of the present invention toy vehicle.

FIG. 3 sets forth a partial section view of the rear portion of truck 10 in which support chassis 13 and transmission 30 may be better observed. Transmission 30 includes a support housing 33 within which an electric drive motor 50 (seen in FIG. 4) is supported in accordance with conventional fabrication techniques. Motor 50 includes an output shaft 51 supporting an output gear 52 in accordance with conventional fabrication techniques. Gear 52 is coupled to a gear 53 which in turn is coupled to smaller diameter gear 54. Gear 54 is commonly formed with a larger diameter gear 55 which is coupled to a reduced diameter gear 56. Gear 56 is commonly formed with a larger diameter gear 57. Thus, the combination of gears 53 through 57 form a conventional speed reduction gear train in which successive smaller diameter gears beginning with output gear 52 of motor 50 are alternately coupled with larger diameter gears to provide an overall speed reduction between the rotational speed of output gear 52 of motor 50 and the rotational speed of the final gear in the gear reduction set which is gear 57. It will be apparent to those skilled in the art that a great variety of speed reduction gear configurations may be utilized to provide speed reduction and gain a power advantage as a result with the essential feature being the coupling of power from output gear 52 of motor 50 to a compound gear comprising gears 58 and 59.

Gears 58 and 59 (better seen in FIG. 4) comprise gears having different outer diameters which are commonly supported and integrally formed with a cylindrical member 62. Thus, in its preferred form, the combination of gears 58 and 59 and cylindrical member 62 are formed of a common integrally molded single unit.

Rear axle 31 is coupled to rear wheel hubs 22 and 23 (seen in FIG. 1) by conventional attachment techniques. Rear axle 31 passes through transmission housing 33 forming a continuous cylindrical member as is better seen in FIGS. 5 and 6. In accordance with an important aspect of the present invention, transmission 30 further includes a gear switching assembly 70, the structure of which is better seen in FIGS. 5 and 6, supported within transmission housing 33 in a manner such that rear axle 31 extends therethrough. The structure of gear switching assembly 70 is described below in connection with FIGS. 5 and 6 in greater detail. However, suffice it to note here that gear switching assembly 70 includes a pair of gears 60 and 61 having different diameters which engage gears 58 and 59 respectively. Thus, it should be understood that gears 60 and 61 are sized in accordance with the relative sizes of gears 58 and 59 such that they properly engage gears 58 and 59. By means set forth below in greater detail, gear 58 engages gear 60 while gear 59 engages gear 61 providing alternative gear ratio coupling combinations within gear switching assembly 70. Thus, as is better set forth below and described in more detail in connection with FIGS. 5 and 6, the operative power coupled from output gear 52 of motor 50 through gears 53 through 57 rotates gears 58 and 59 at the same angular speed. A switching gear within gear switching assembly 70 described in FIGS. 5 and 6 switches between coupling engagement to gears 60 or 61 to transfer the operating power to rear axle 31 at either of two gear ratios.

Figure 4:
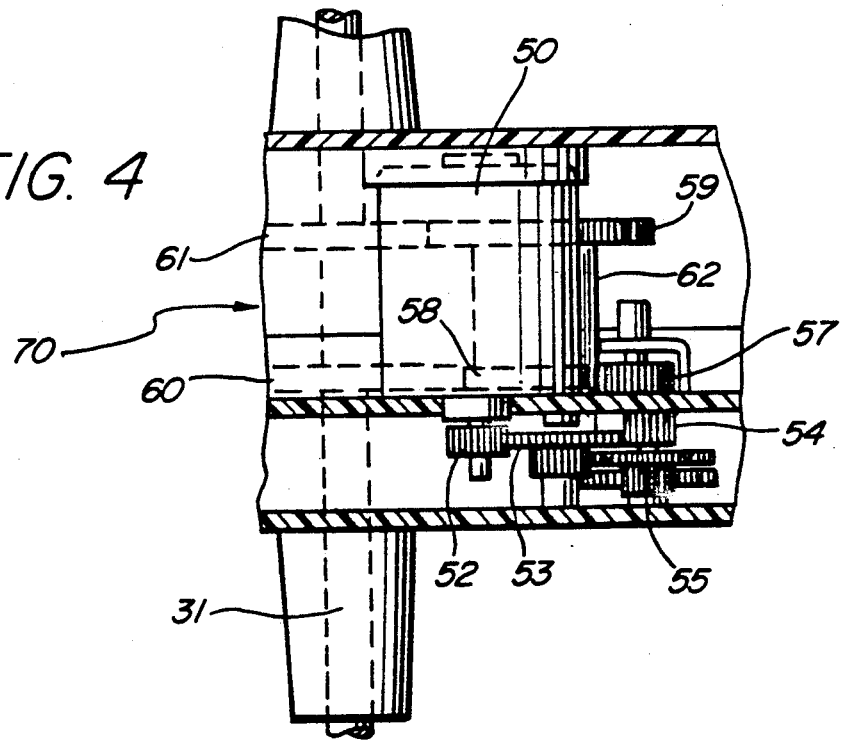
FIG. 4 sets forth a partial section view of the motor drive portion of the present invention toy vehicle taken along section lines 4—4 in FIG. 3.

FIG. 4 sets forth a section view of transmission 30 taken along section lines 4—4 in FIG. 3. As is set forth above, transmission 30 includes a housing 33 supporting a motor 50 having an output gear 52. A plurality of speed reduction gears 53 through 57 are operative in the manner described above to provide speed reduction for the output power of motor 50. A pair of gears 58 and 59 are integrally formed with a support cylinder 62. Gear 58 engages and is driven by gear 57 which forms the output gear of the above-described speed reduction gears 53 through 57. Gear switching assembly 70 is supported upon rear axle 31 in the manner set forth below in FIGS. 5 and 6 and includes a pair of input gears 60 and 61 which engage gears 58 and 59 respectively. In accordance with an important aspect of the present invention, gears 58 and 59 are commonly coupled and thus rotate at a constant angular speed. In contrast, gears 60 and 61 of gear switching assembly 70 are independently supported and thus capable of rotation at different angular speeds. Thus, a gear coupling of one ratio is obtained by the coupling between gear 59 and gear 61 while an alternate gear ratio coupling is obtained between gears 58 and 60. In this way, the gear switching mechanism within assembly 70 is able to select between coupling axle 31 to gear 61 to provide a higher speed lower power coupling or, alternatively, to be coupled to gear 60 providing a lower speed higher power gear coupling. By means set forth below in FIGS. 5 and 6, the selection of gear ratio coupling within gear switching assembly 70 is controlled in response to the resisting load imposed upon transmission 30.

Figure 5:
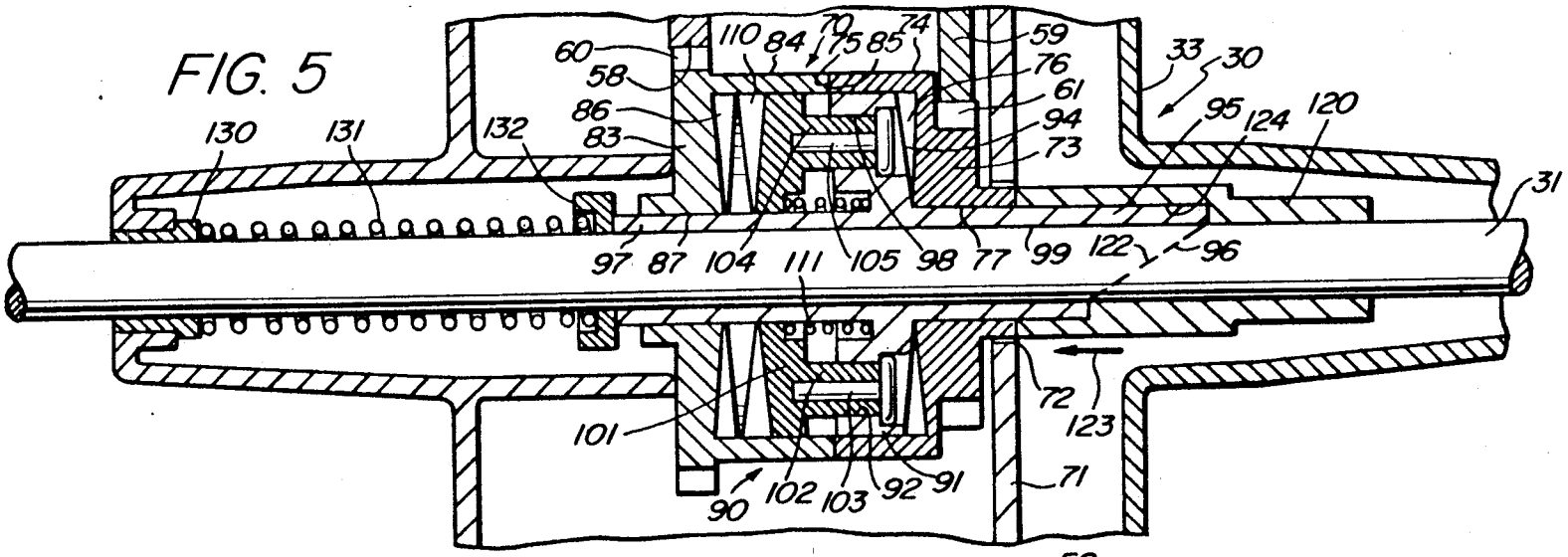
FIGS. 5 and 6 set forth section view of the gear shift portion of the present invention toy vehicle taken along section lines 5—5 in FIG. 3.
Figure 6:
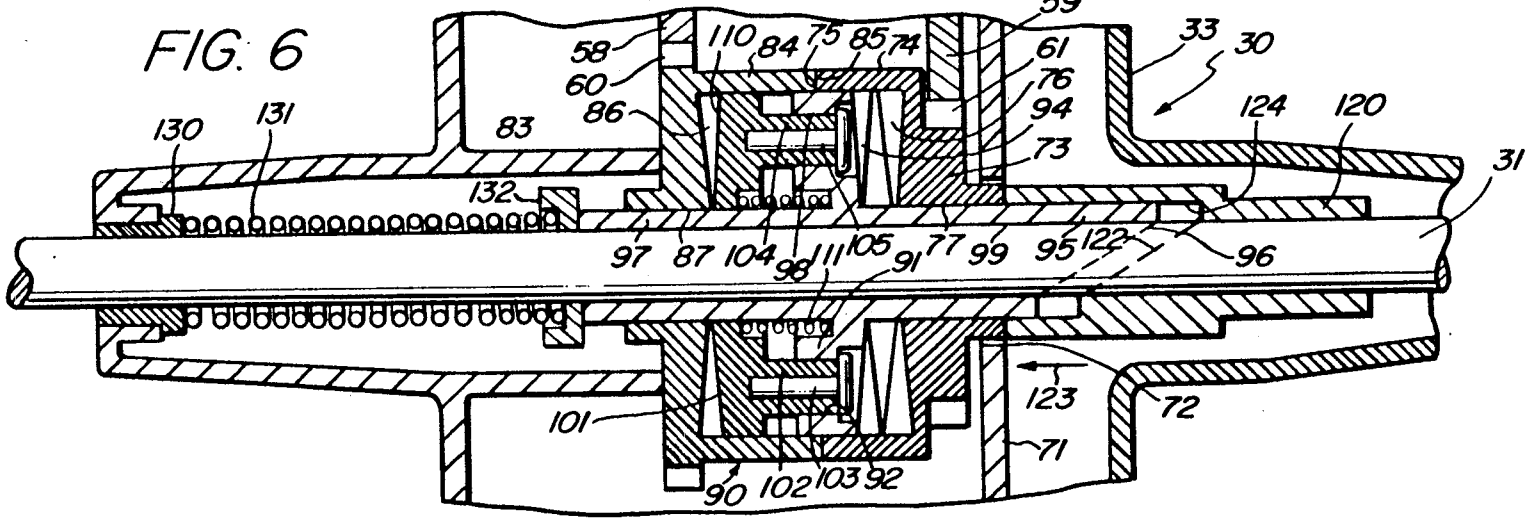

FIGS. 5 and 6 set forth section views of transmission 30 taken along section lines 5—5 in FIG. 3. With specific reference to FIG. 5, transmission 30 includes a hollow housing 33 which defines an interior wall 71. Wall 71 defines an aperture 72. Rear axle 31 extends through transmission housing 33 and supports a pair of collars 130 and 132 which captivate a coil spring 131 received upon rear axle 31. Gear switching assembly 70 includes a pair of half portions 73 and 83 formed of a pair of inwardly facing generally cylindrical members 74 and 84 respectively. Cylindrical portions 74 and 84 define respective edge portions 75 and 85 which slidably contact along a common seam. Half portion 73 includes a gear 61 integrally formed therein and a passage 77 through which axle 31 extends. Similarly, half portion 83 includes a gear 60 and an internal passage 87 which also receives rear axle 31. In accordance with an important aspect of the present invention, half portion 73 defines an inwardly facing multiply faceted face 76 which, in its preferred form, comprises a saw-tooth like triangular segment gear. Correspondingly, half portion 83 defines a similar inwardly facing multiply faceted facet 86 which also in its preferred form comprises a saw-tooth like arrangement of triangular gear facets.

Gear switching assembly 70 further includes a switching gear generally referenced by numeral 90 which is received within the interior cavity formed by drum portions 74 and 84 of half portions 73 and 83 respectively. Switching gear 90 is formed of a pair of gear halves 91 and 101. Gear half 91 includes a pair of generally cylindrical collars 97 and 95 which define a common axle passage 99. Collar 97 extends through passage 87 of half portion 83 while collar 95 extends through passage 77 of half portion 73. Collars 95 and 97 define a coextensive passage 99 which receives axle 31. In accordance with an important aspect of the present invention, passage 99 is large enough with respect to the diameter of axle 31 to permit collars 95 and 97 to move freely upon axle 31. Collar 95 further includes an angled cam surface 96 at the extreme end thereof. A generally cylindrical sleeve 120 defines a center passage 121 which receives axle 31 and an angled cam surface 122. Sleeve 120 further defines a passage 124 which receives collar 95. By conventional fabrication means such as adhesive bonding or a retaining pin or the like, sleeve 120 is securely fastened to axle 31. Gear half 91 further includes a multiply faceted gear face 94 configured to cooperate with and engage faceted face 76 of half portion 73.

Gear half 101 is received upon and supported by collar 97 of gear half 91 and includes a multiply faceted gear face 110 configured to cooperate with and engage faceted face 86 of half portion 83. Gear half 91 defines a pair of passages 92 and 98 while gear half 101 defines a corresponding pair of cylindrical posts 102 and 104 which are received therein to provide an engaging attachment between gear halves 91 and 101. A pair of rivets 103 and 105 are received within posts 102 and 104 respectively to complete the attachment thereof. In accordance with an important aspect of the present invention, gear halves 101 and 91 include a captivated spring 111 which urges gear halves 91 and 101 apart slightly to provide a spring loaded expansion capability therebetween. The degree of expansion permitted between gear halves 91 and 101 is controlled by rivets 103 and 105. In accordance with a further important aspect of the present invention, the width of switching gear 90 formed by gear halves 91 and 101 is less than the spacing between multiply faceted face 76 of half portion 73 and multiply faceted face 86 of half portion 83. Thus, switching gear 90 may, alternatively, engage half portion 73 while being disengaged from half portion 83 in the manner shown in FIG. 5 or engage half portion 83 while being disengaged from half portion 73 in the position shown in FIG. 6. Since half portions 73 and 83 of gear switching assembly 70 are independently rotatable upon collars 95 and 97 respectively, they are able to move at different angular speeds.

The operation of the present invention transmission is best understood by simultaneously viewing FIGS. 5 and 6. FIG. 5 describes the higher speed normal load configuration which results in the absence of a strong resisting load or resisting torque imparted to axle 31 by high load conditions such as those shown in FIG. 2. In this configuration, the coupler formed by collar 95 and sleeve 120 positions switching gear 90 such that it engages half portion 73. Simultaneously, therefore, half portion 83 is disengaged from switching gear 90. As a result, the power coupling between axle 31 and motor 50 (seen in FIG. 4) passes through the combination of gear 59 and 61. Conversely, under heavy load conditions, a strong resisting torque is encountered by axle 31. This resisting torque causes cam surfaces 96 and 122 to produce a separating action for the coupler formed by collar 95 and sleeve 120. This separating action is opposed by spring 131. However, once the spring force of spring 131 is overcome, this camming action forces collar 95 and thereby switching gear 90 in the direction indicated by arrow 123 to the position shown in FIG. 6. In this position, switching gear 90 disengages half portion 73 and engages half portion 83. As a result, the power coupling between axle 31 and motor 50 (seen in FIG. 4) now passes through gears 58 and 60. This coupling continues so long as sufficient opposing torque or load is sensed within the coupler formed by collar 95 and sleeve 120 as evidenced by the expansion or separation caused by cam surfaces 96 and 122.

Thus, under normal circumstances, the gear coupling is that shown in FIG. 5 in which the transmission gear ratios include larger diameter gear 59 driving smaller diameter gear 61 which provides a higher rotational speed for rear axle 31 and produces normal vehicle speed. Conversely, under the high load conditions shown in FIG. 6, the gear coupling of the transmission includes a smaller diameter gear 58 driving a larger diameter gear 60 which produces a lower rotational speed of axle 31 while increasing the available power or torque to overcome obstacles and high load terrain circumstances.

The spring action of spring 111 and the expansion capability of gear halves 91 and 101 of switching gear 90 provide a more reliable and even transition between the gear switch configuration shown.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle comprising:

a toy vehicle body having at least one drive wheel;

a motor; and a load responsive transmission coupling said motor to said at least one drive wheel having means for changing the gear ratio thereof in response to resisting load, said transmission including:

a drive axle couple to said at least one drive wheel;

a pair of half portions defining a pair of gears having different gear diameters commonly coupled to said motor and having inwardly facing engagement surfaces in a spaced apart relationship defining a space therebetween;

a shifting gear interposed between said pair of spaced apart gears and having a pair of outwardly facing engagement surfaces engaging either of said inwardly facing engagement surfaces; and a load responsive coupler coupled between said drive axle and said shifting gear, said load responsive coupler causing said shifting gear to move into engagement with one of said pair of spaced apart gears in response to increased load and to the other of said pair of spaced apart gears in response to decreased load without loss of engagement.

2. A toy vehicle as set forth in claim 1 wherein said transmission includes a spring biasing said shifting gear and said coupler toward a decreased load configuration.

3. A toy vehicle comprising:

a toy vehicle body;

a plurality of wheels coupled to said body;

a motor having an output shaft and an output gear supported thereon;

transmission means having first and second half portions defining respective integrally formed outwardly facing first and second differently sized gears and first and second spaced apart inwardly facing multi-faceted faces, and a switching gear interposed between said first and second multi-faceted faces and defining outwardly facing first and second gear faces, said switching gear being large enough with respect to said spacing between said first and second inwardly facing multi-faceted faces to maintain coupling between either said first multi-faceted face and said first gear face in a first position or said second multi-faceted face and said second gear face in a second position;

gear means commonly coupling said first and second outwardly facing gears to said output gear; and a load torque responsive expandable coupler coupling said switching gear to at least one of said wheels and moving said switching gear between said first and second positions in response to resisting torque as said motor turns.

4. A toy vehicle as set forth in claim 3 wherein said load torque responsive expandable coupler includes spring means biasing said switching gear toward said first position and a first cam member secured to said switching gear and a second cam member coupled to said at least one of said wheels, said cam members responding to resisting load torque to overcome said spring means and move said switching gear to said second position without loss of engagement between said switching gear and said half portions.

5. A toy vehicle as set forth in claim 4 wherein said first and second inwardly facing multi-faceted faces each define a plurality of angled facets, and wherein said first and second gear faces define respective first and second outwardly facing pluralities of angled facets normally engaging said first multi-faceted face and movable as said coupler expands in response to increased resisting load to disengage from said first multi-faceted face and engage said second multi-faceted face.

* * * * *